US007053855B2

(12) United States Patent
Huang

(10) Patent No.: US 7,053,855 B2
(45) Date of Patent: May 30, 2006

(54) STRUCTURE OF 3D INVERTED F-ANTENNA

(75) Inventor: Wen-Man Huang, Miaoli (TW)

(73) Assignee: Z-COM, Inc. (TW)

( * ) Notice: Subject to any disclaimer, the term of this patent is extended or adjusted under 35 U.S.C. 154(b) by 93 days.

(21) Appl. No.: 10/747,208

(22) Filed: Dec. 30, 2003

(65) Prior Publication Data

US 2004/0196194 A1 Oct. 7, 2004

(30) Foreign Application Priority Data

Apr. 4, 2003 (TW) ..... 92205345 U

(51) Int. Cl.
*H01Q 11/00* (2006.01)
*H01Q 1/48* (2006.01)

(52) U.S. Cl. ..... 343/843; 343/846; 343/700 MS

(58) Field of Classification Search ..... 343/700 MS, 343/702, 845–846, 843, 912
See application file for complete search history.

(56) References Cited

U.S. PATENT DOCUMENTS 6,218,991 B1 * 4/2001 Sanad ..... 343/700 MS
6,297,776 B1 * 10/2001 Pankinaho ..... 343/700 MS
6,392,609 B1 * 5/2002 Nieminen ..... 343/767
6,480,156 B1 * 11/2002 Tsai et al. ..... 343/700 MS
6,538,604 B1 * 3/2003 Isohatala et al. ..... 343/700 MS
6,639,559 B1 * 10/2003 Okabe et al. ..... 343/700 MS
2003/0146878 A1 * 8/2003 Mikkola et al. ..... 343/702

* cited by examiner

*Primary Examiner*—Thuy Vinh Tran
(74) *Attorney, Agent, or Firm*—Lowe, Hauptman & Berner, LLP

(57) ABSTRACT

Disclosed is a 3D inverted F-antenna for easy production, fast assembly, wider bandwidth that provides excellent capacity of radiating and receiving wireless signal inside wireless communication devices. The 3D inverted F-antenna includes a ground plate. A radiating plate has a hole wherein the dimensions of the radiating plate and the hole are decided by ½ of the predetermined resonance wavelength. A shorting unit is connected to the ground plate and the radiating plate. A media is located between the ground plate and the radiating plate for isolating the ground plate and the radiating plate. A conductive signal feeding device is located in the ground plate and electrically coupled to the radiating plate for transmitting signal.

11 Claims, 14 Drawing Sheets

SWR

RETURN LOSS

SMITH CHART

THETA=90° (X,Y PLANE)
TOTAL FIELD
F=2.45GHZ
MAX 1.3dbi min -0.4dbi

THETA=90° (X,Y PLANE)
Co pol. (vertical pol.)
F=2.45GHZ
MAX 1.2dbi min –1.75dbi

THETA=90° (X,Y PLANE)
Cross pol. (horizontal pol.)
F=2.45GHZ
MAX –2.5dbi min –30dbi phi=0° (X,Z PLANE)
TOTAL FIELD
F=2.45GHZ
MAX 2.5dbi min -21dbi phi=0° (X,Z PLANE)
Co pol. (vertical pol.)
F=2.45GHZ
MAX 2.5dbi min –26dbi PHI=0° (X,Z PLANE)
Cross pol. (horizontal pol.)
F=2.45GHZ
MAX −17dbi min −50dbi PHI=90° (Y,Z PLANE)
TOTAL FIELD
F=2.45GHZ
MAX 1.7dbi min −7.5dbi PHI=90° (Y,Z PLANE)
Co pol. (vertical pol.)
F=2.45GHZ
MAX –1.6dbi min –45dbi PHI=90° (Y,Z PLANE)
Cross pol. (horizontal pol.)
F=2.45GHZ
MAX 1.0dbi min –7.5dbi

STRUCTURE OF 3D INVERTED F-ANTENNA

BACKGROUND OF THE INVENTION

1. Field of the Invention

The present invention relates to a structure of 3D inverted F-antenna, and more particularly to a structure of 3D inverted F-antenna, which is set into an electric device.

2. Description of the Prior Art

As communication technology has become more and more advanced, the related products are varied with its increasing applications in all fields. Besides, many kinds of communication products with different designs and functions are proposed due to the requests of the customers. For example, the PC networking products are currently popular as a result of convenience of wireless communication. In addition, as the technology of the integrated circuit (IC) is developed, the designs of communication devices tend to be compact size and light weight.

It is important to study and design the antenna, which is one of the components in the communication product for transmitting and receiving signals. Normally, we can realize the characteristics of the antenna by the parameters of Operating Frequency, Radiation Pattern, Return Loss, and Antenna Gain of the antenna.

Conventionally, the type of the antenna is primary a coil which is a roll of metal wire. The predetermined functions will be affected by the diameter, material, pitch, and the length of the helix antenna. However, as the antenna is protruding and external, the dimension of the product is increased and can't fit the requested designs of compact size and light weight.

Thus, tiny or planar microstrip antenna is invented to achieve above-mentioned requests. In the early years, the microstrip antenna comprises a circle or a rectangular thin metal sheet, as disclosed in the U.S. Pat. Nos. 3,921,177 and 3,810,183, and then dielectric is filled into the space between said thin metal sheet and the ground. Typically, the microstrip antenna works under narrow bandwidth. As to the polygonal helical microstrip antenna for improving the early microstrip antenna as described in the U.S. application number of Ser. No. 07/695,686, its bandwidth is closed to that of general helical antenna with constant impedance. But the disadvantage is that the diameter of the antenna will increase when it works at the low frequency. It cannot be carried in a pocket, either.

Recently, the most common used antenna such as Planer Inverted F-Antenna (PIFA) is a continuation of the conventional Inverted F-Antenna. The characteristics of PIFA are compact size, simple in structure, and easy to design, it is applied to many kinds of communication products or systems thereby.

The structure of the conventional inverted F-antenna 1 is described with reference to FIG. 1. A metal wire 11 is connected to the ground plate 10. And a short point 12 is connected to one terminal of the metal wire 11. Besides, a feed point 13 for connecting to a coax feed 14 is adjacent to the short point 12. Therefore, a single frequency antenna is formed.

The conventional inverted F-antenna can be developed to the Planer Inverted F-Antenna (PIFA) 2 as shown in FIG. 2. The PIFA 2 comprises a ground plate 20, a radiating plate 21, a short plate 22, a conductive signal feeding device 23, and a media 24 being between and isolating the ground plate 20 and the radiating plate 21. The media can be air, Styrofoam, microwave substrate, or the combination. Besides, the two ends of the short plate 22 are welded to the ground plate 20 and the radiating plate 21, respectively. The conductive signal feeding device 23 is in the ground plate 20 and coupled to the radiating plate 21 for transmitting signals. Further, the conductive signal feeding device 23 can be a TEM wire including an inner conductor 231 and an outer conductor 232 which are welded to the radiating plate 21 and the ground plate 20, respectively. While it works, the length of the antenna can be reduced to ¼ of the resonance wavelength due to the structure of the antenna.

However, when the PIFA as mentioned above is placed in some communication products such as a cellular phone or a notebook, good signal transmitting and receiving cannot often be provided. Furthermore, it is not convenient to manufacture and maintain the antenna due to the accuracy of the high welding technologies. Thus, for the manufacturer, the terms of high performance, low cost, and simple to manufacture cannot be achieved.

SUMMARY OF THE INVENTION

In the light of the state of the art described above, it is an object of the present invention to provide a 3D inverted F-antenna, which can improve the disadvantages as mentioned above.

It is another object of the invention to provide a 3D inverted F-antenna, which is set into a communication device and simple to manufacture.

It is a further object of the invention to provide a 3D inverted F-antenna, which is set into a communication device and can work under a wide range of bandwidth.

It is also an object of this invention to provide a 3D inverted F-antenna, which is set in a communication device and can provide good signal radiating and receiving.

In view of the above and other objects which will become apparent as the description proceeds, there is provided according to a general aspect of the present invention a structure of 3D inverted F-antenna, which comprises a ground plate; a radiating plate with a hole wherein the dimensions of said radiating plate and said hole are decided by one over two of a predetermined resonance wavelength; a short unit connecting said radiating plate and said ground plate; a media located between said ground plate and said radiating plate for isolating said ground plate and said radiating plate; and a conductive signal feeding device located in said ground plate and electrically coupled to said radiating plate for transmitting signal.

Base on the idea described above, wherein said radiating plate is a metal sheet.

Base on the aforementioned idea, wherein the shape of said metal sheet is rectangular.

Base on the idea described above, wherein the shape of said hole is rectangular.

Base on the aforementioned idea, wherein the short unit is a metal sheet for shorting.

Base on the idea described above, wherein said ground plate, said radiating plate, said hole, and said short unit are formed by the all-in-one process.

Base on the aforementioned idea, wherein the material of said media is selected from the group consisting of air, Styrofoam, and microwave substrate.

Base on the idea described above, wherein said predetermined resonance wavelength is in the ISM (Industry—Science—Medicine) bandwidth.

Base on the aforementioned idea, wherein said conductive signal feeding device has a TEM wire.

Base on the idea described above, wherein said ground plate further comprises a first sidewall and a second sidewall.

Base on the aforementioned idea, wherein said first sidewall and said second sidewall are symmetrically located at both side of said radiating plate.

Base on the idea described above, wherein said ground plate, said radiating plate, said hole, said short unit, said first sidewall, and said second sidewall are formed by the all-in-one process.

Base on the aforementioned idea, wherein said ground plate further comprises a reflector.

Base on the idea described above, wherein said ground plate further comprises a first sidewall and a second sidewall.

Base on the aforementioned idea, wherein said first sidewall and said second sidewall are symmetrically located at both side of the radiating plate.

Base on the idea described above, wherein said ground plate, said radiating plate, said hole, said short unit, said reflector, said first sidewall, and said second sidewall are formed by the all-in-one process.

Base on the aforementioned idea, wherein the space between said radiating plate and said ground plate is higher than the value of 0.03 multiplying said predetermined wavelength.

In view of the above and other objects which will become apparent as the description proceeds, there is provided according to a general aspect of the present invention a structure of 3D inverted F-antenna, which comprises a ground plate with a reflector, a first sidewall, and a second sidewall; a metal sheet with a hole wherein the dimensions of said metal sheet and said hole are decided by one over two of a predetermined resonance wavelength; a short metal sheet connecting said metal sheet and said ground plate; a media located between said ground plate and said metal sheet for isolating said ground plate and said metal sheet; and a TEM wire located in said ground plate and electrically coupled to said metal sheet for transmitting signal.

Base on the idea described above, wherein the material of said media is selected from the group consisting of air, Styrofoam, and microwave substrate.

Base on the aforementioned idea, wherein said predetermined resonance wavelength is in the ISM (Industry—Science—Medicine) bandwidth.

Base on the idea described above, wherein said first sidewall and said second sidewall are symmetrically located at both side of said radiating plate.

Base on the aforementioned idea, wherein said ground plate, said metal sheet, said hole, said short metal sheet, said reflector, said first sidewall, and said second sidewall are formed by the all-in-one process.

Base on the idea described above, wherein the space between said metal sheet and said ground plate is higher than the value of 0.03 multiplying the predetermined wavelength.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Some sample embodiments of the present invention will now be described in greater detail. Nevertheless, it should be recognized that the present invention can be practiced in a wide range of other embodiments besides those explicitly described, and the scope of the present invention is expressly not limited except as specified in the accompanying claims.

Figure 1:
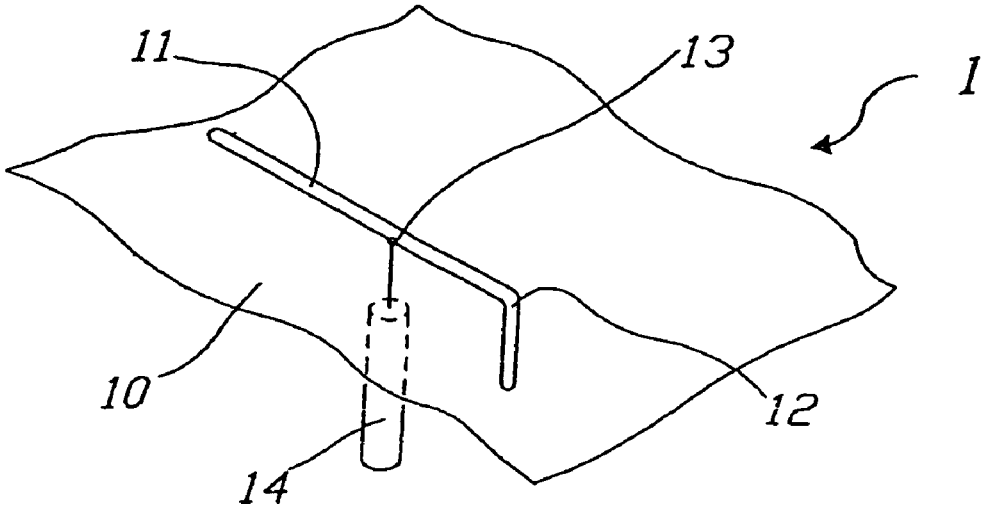
Fig. 1 PRIOR ART
FIG. 1 schematically shows the structure of the conventional inverted F-antenna.
Figure 2:
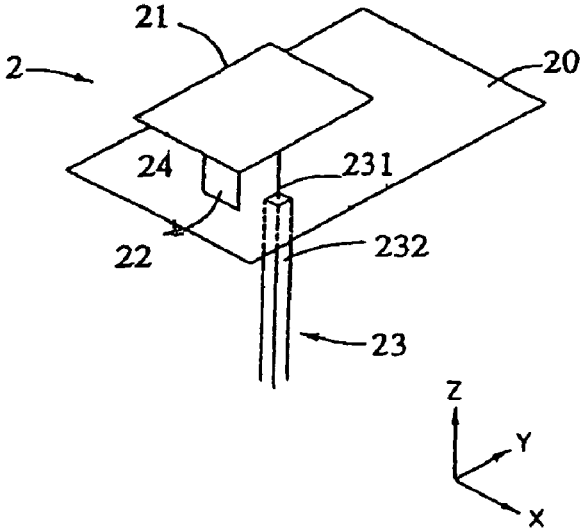
Fig. 2 PRIOR ART
FIG. 2 schematically shows the structure of the conventional planer inverted F-antenna.
Figure 3:
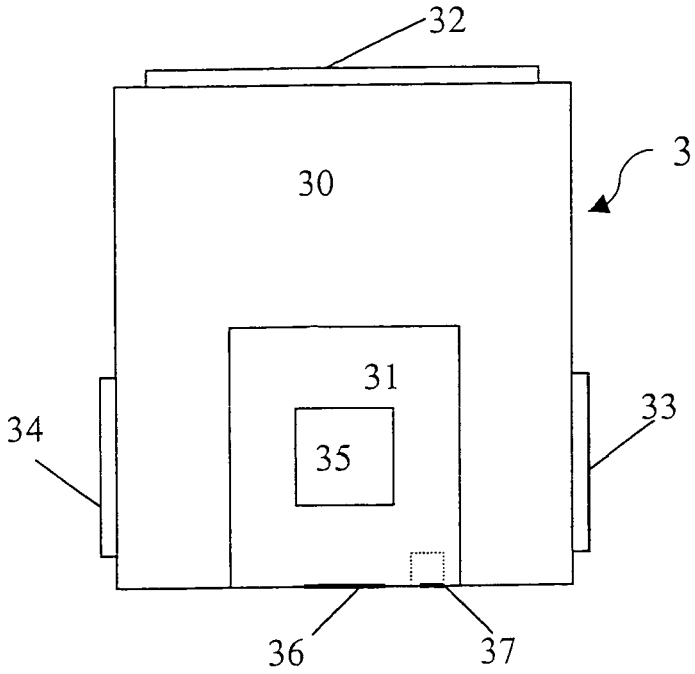
FIG. 3 shows the top view of the structure of the 3D inverted F-antenna according to the present invention.
Figure 4:
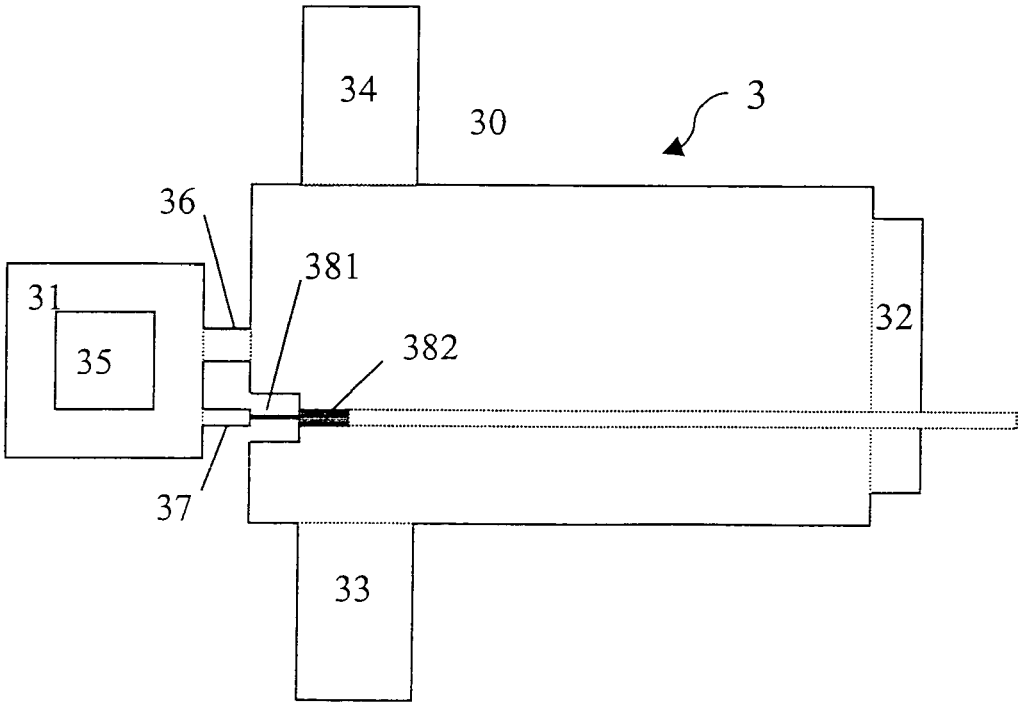
FIG. 4 shows the top view of the non-folding structure of the 3D inverted F-antenna according to the present invention.

Referring to FIG. 3, and FIG. 4, which show the top view of the structure of the 3D inverted F-antenna 3 and the non-folding structure of the 3D inverted F-antenna according to the present invention, respectively. As shown in FIG. 3 and FIG. 4, a radiating plate 31 is located on a ground plate 30, and a reflector 32 is opposite to the ground plate 30. Besides, a first sidewall 33 and a second sidewall 34 are symmetrically located at two sides of the ground plate 30 and are extended from the top. A hole 35, a shorting point 36, a feed point 37, and a conductive signal feeding device 38 are set in the radiating plate 31. The conductive signal feeding device 38 can be a TEM wire including an inner conductor 381 and an outer conductor 382 which are welded to the feed point 37 and the ground plate 30, respectively. The dash lines in FIG. 4 are pointed out the locations for folding.

It is noted that the lengths of the ground plate 30 and the radiating plate 31 are designed corresponding to ½ of a predetermined resonance wavelength in order to work under a wider range of bandwidth. However, the size of this antenna is larger than the conventional planer F-inverted antenna with ¼ of the resonance wavelength. In order to reduce its size, the hole 35 designed corresponding to ½ of a predetermined resonance wavelength is put in the radiating plate 31 to increase the path of the radiating current on the surface so that the resonance frequency can be reduced. In the other words, if the operating frequency is unchanged, the size of the radiating plate 31 with the hole 35 is smaller than that is without the hole 35. Therefore, the size of the antenna can be further reduced.

In addition, the antenna can easily be designed with the impedance of 50 ohms by means of adjusting the sites of the shorting point 36 and the feed point 37. Further, the reflector 32, the first sidewall 33 and the second sidewall 34 are used to receive the vertical polarized wave and horizontal polarized wave for improving the gain of the antenna. To avoid the narrowed bandwidth, the space between the radiating plate 31 and the ground plate 30 are equal to or higher than the value of 0.03 multiplying the predetermined wavelength. The radiating plate 31 and the hole 35 can be the rectangles as shown in FIG. 4 or other shapes designed corresponding to ½ of the predetermined resonance wavelength.

Figure 5:
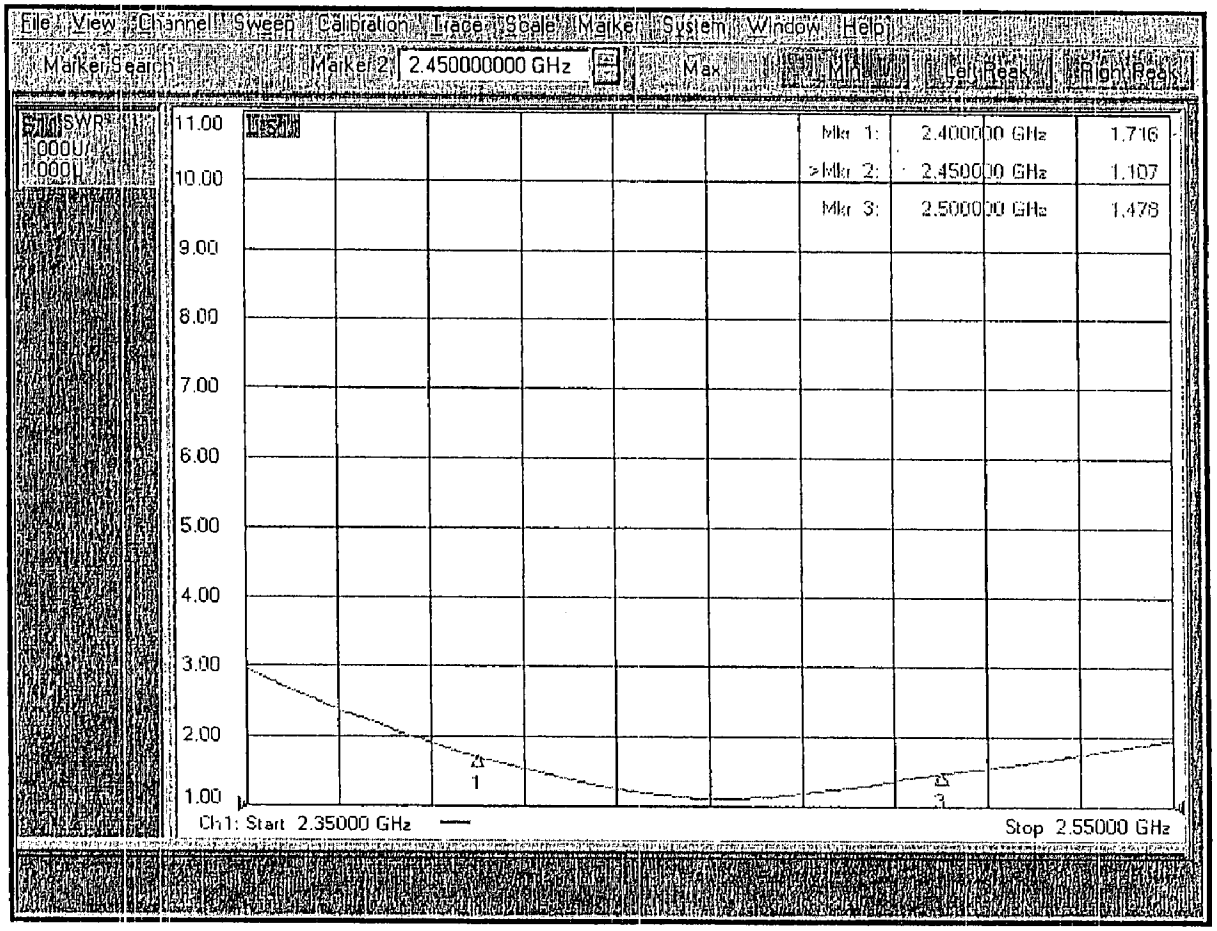
FIG. 5 shows the working properties of the 3D inverted F-antenna according to the present invention.

FIG. 5 shows the figure of the operating frequency and the voltage standing wave ratio (VSWR) of the 3D inverted F-antenna in the ISM (Industry—Science—Medicine) bandwidth (2400~2500 MHz). As shown in FIG. 5, when the antenna works in 2400 MHz (first point), the corresponding VSWR is 1.716. Moreover, when the antenna works in 2450 and 2510 MHz (second and third points), the corresponding VSWR is 1.107 and 1.478, respectively. In conclusion, the VSWR not only achieves the industry standard (VSWR≦2.0) but also is very perfect between 1.107 and 1.716.

Figure 6:
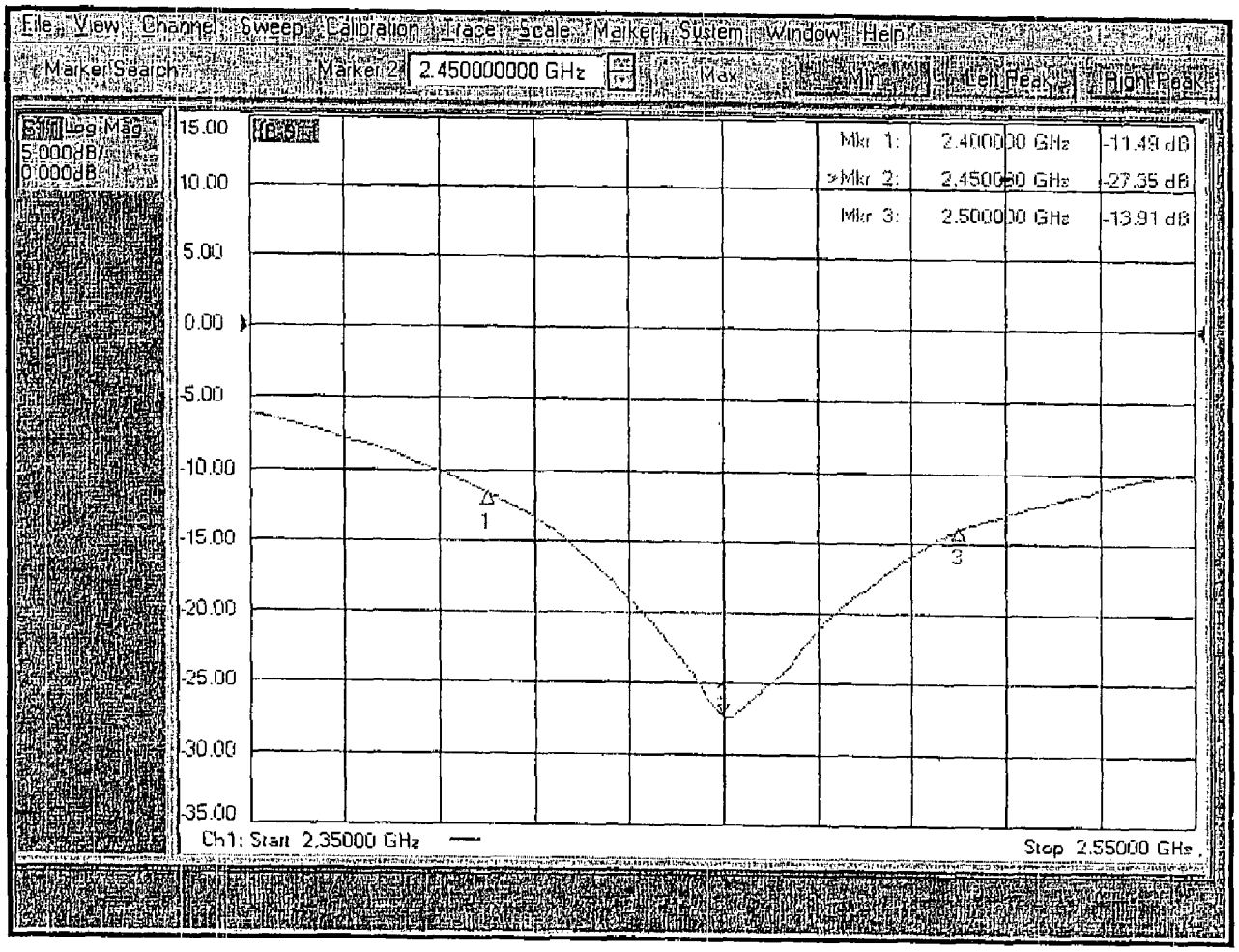
FIG. 6 shows the return loss of the 3D inverted F-antenna according to the present invention.
Figure 7:
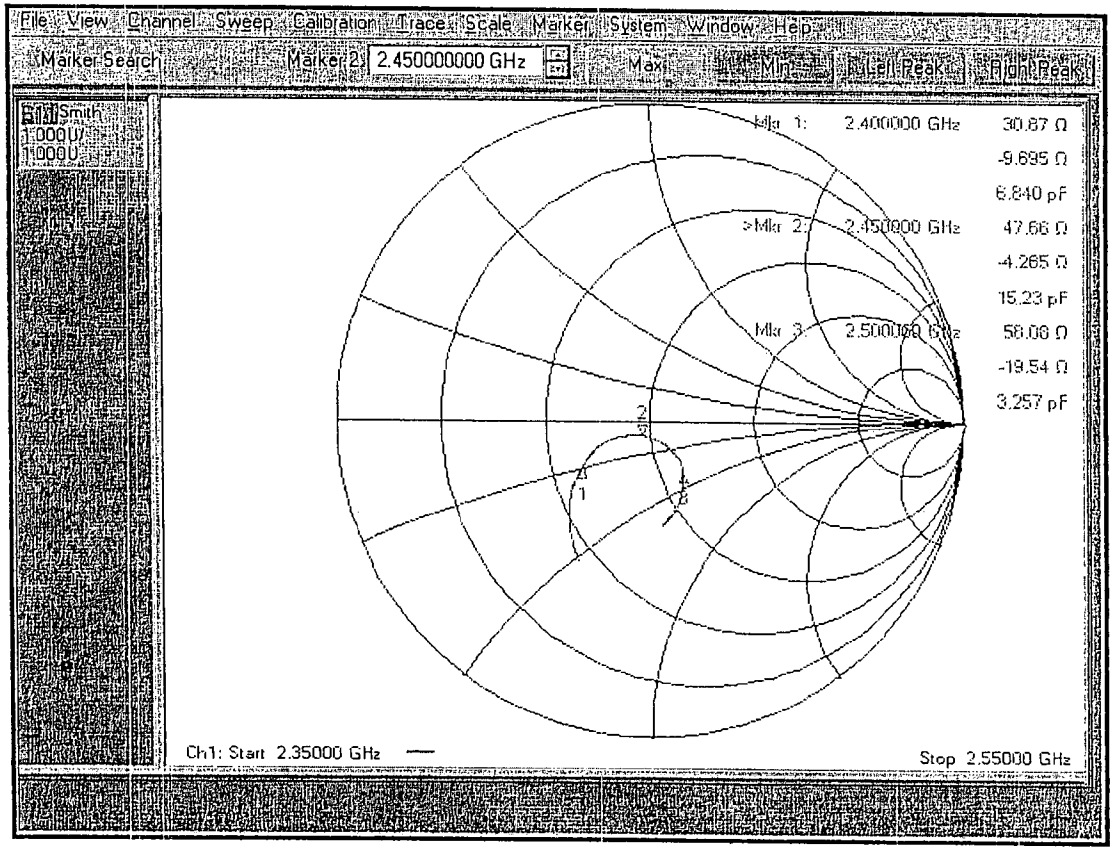
FIG. 7 shows the Smith Chart of the 3D inverted F-antenna according to the present invention.
Figure 8:
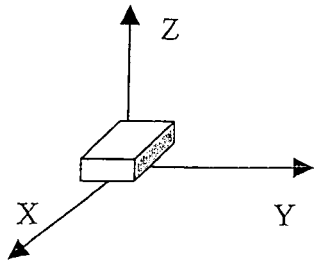
FIG. 8 shows the total radiation field of the X-Y plane of the 3D inverted F-antenna according to the present invention, operating at the frequency of 2450 MHz.
Figure 8:
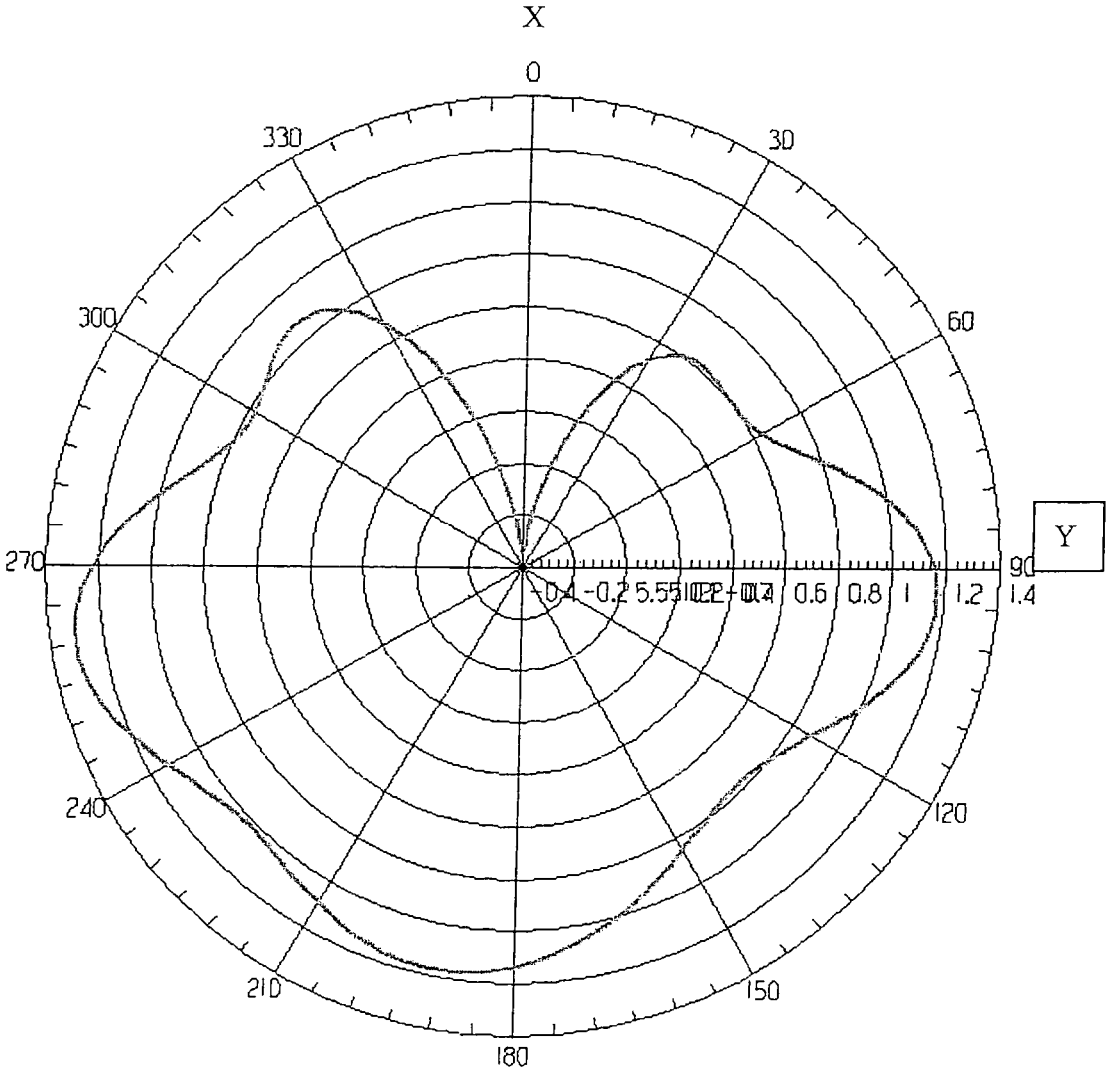
Figure 9:
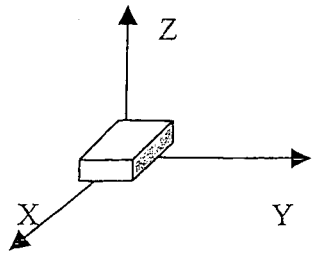
FIG. 9 shows the vertical polarized radiation field of the X-Y plane of the 3D inverted F-antenna according to the present invention, operating at the frequency of 2450 MHz.
Figure 9:
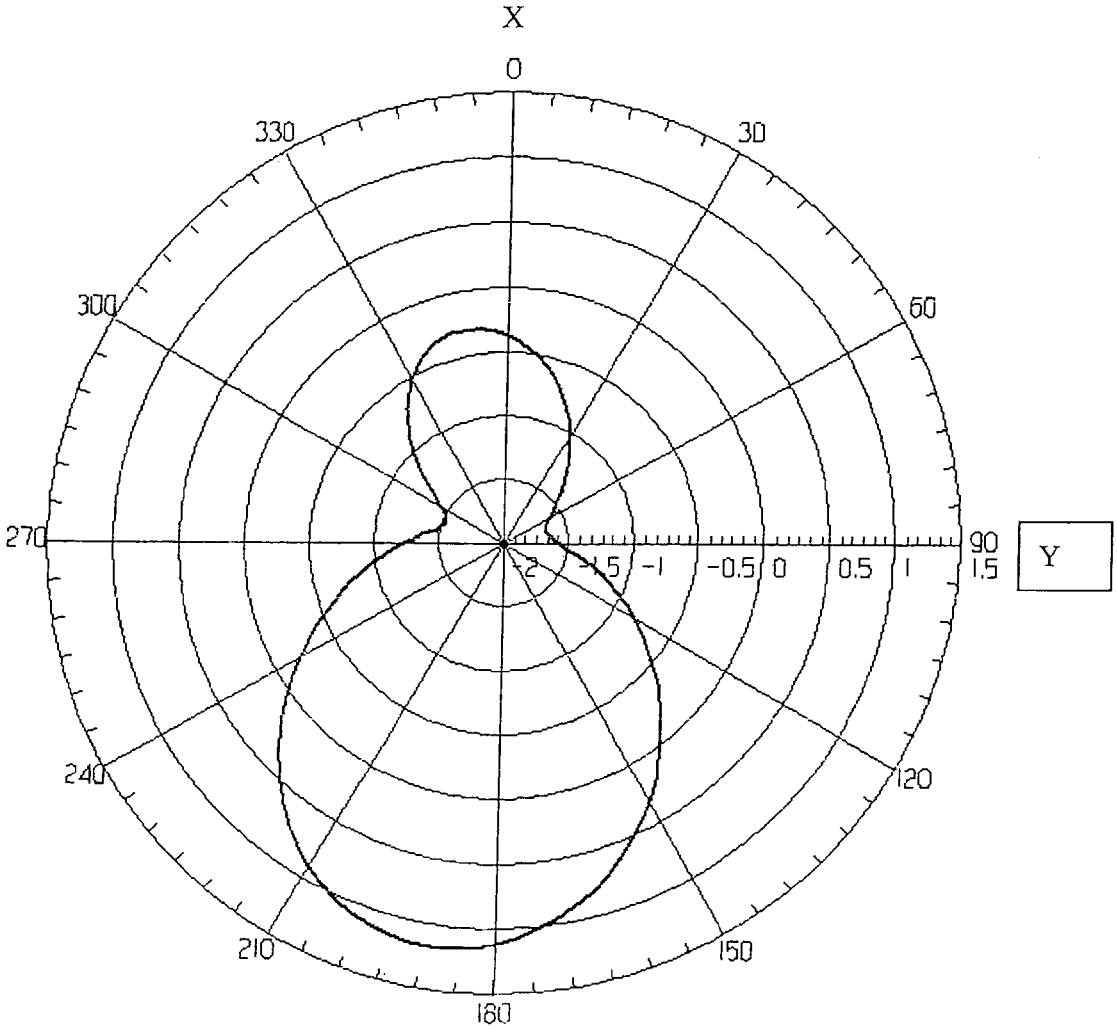
Figure 10:
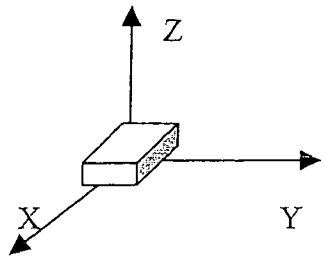
FIG. 10 shows the horizontal polarized radiation field of the X-Y plane of the 3D inverted F-antenna according to the present invention, operating at the frequency of 2450 MHz.
Figure 10:
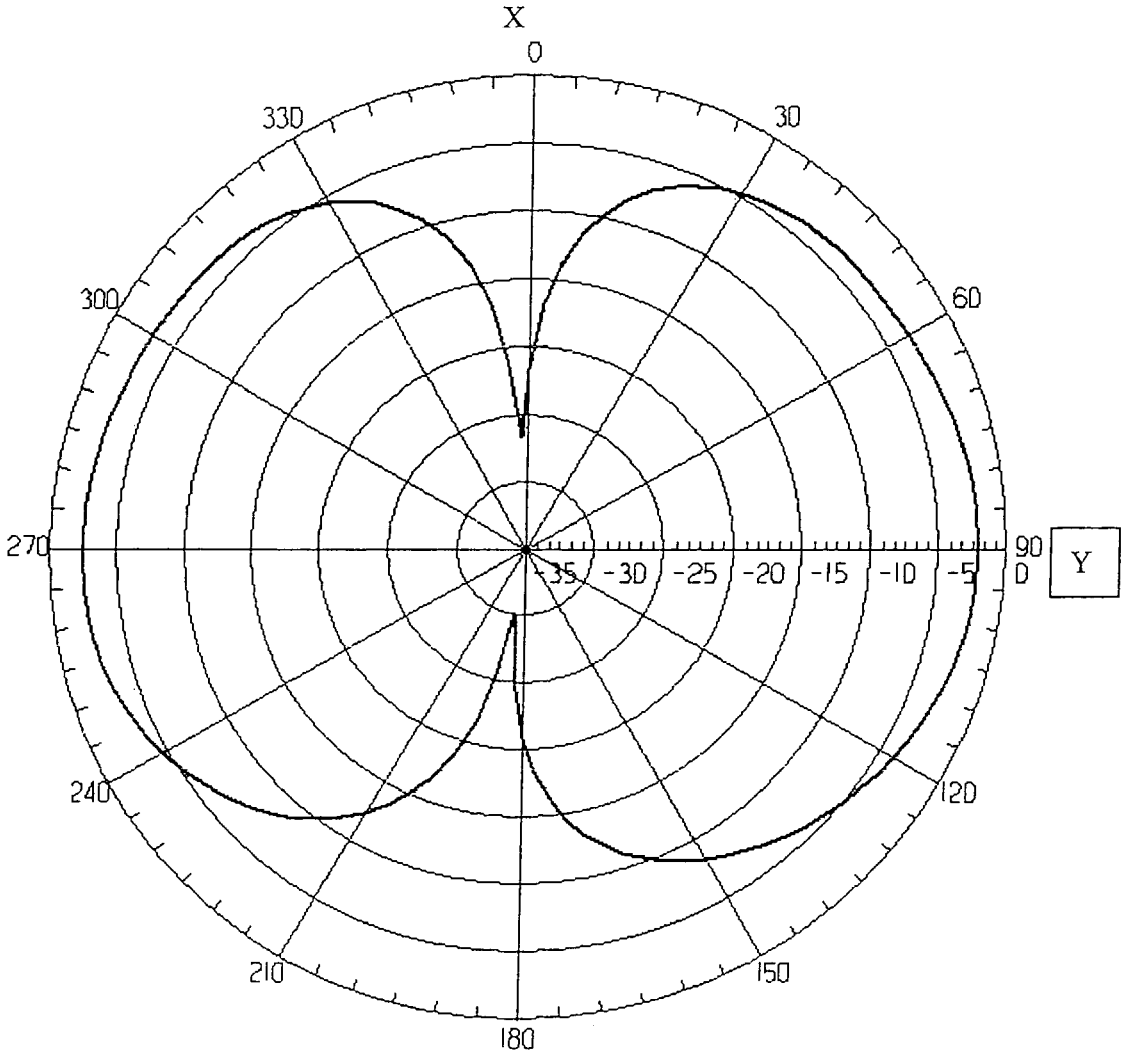
Figure 11:
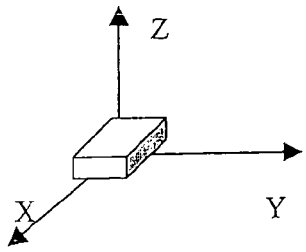
FIG. 11 shows the total radiation field of the X-Z plane of the 3D inverted F-antenna according to the present invention, operating at the frequency of 2450 MHz.
Figure 11:
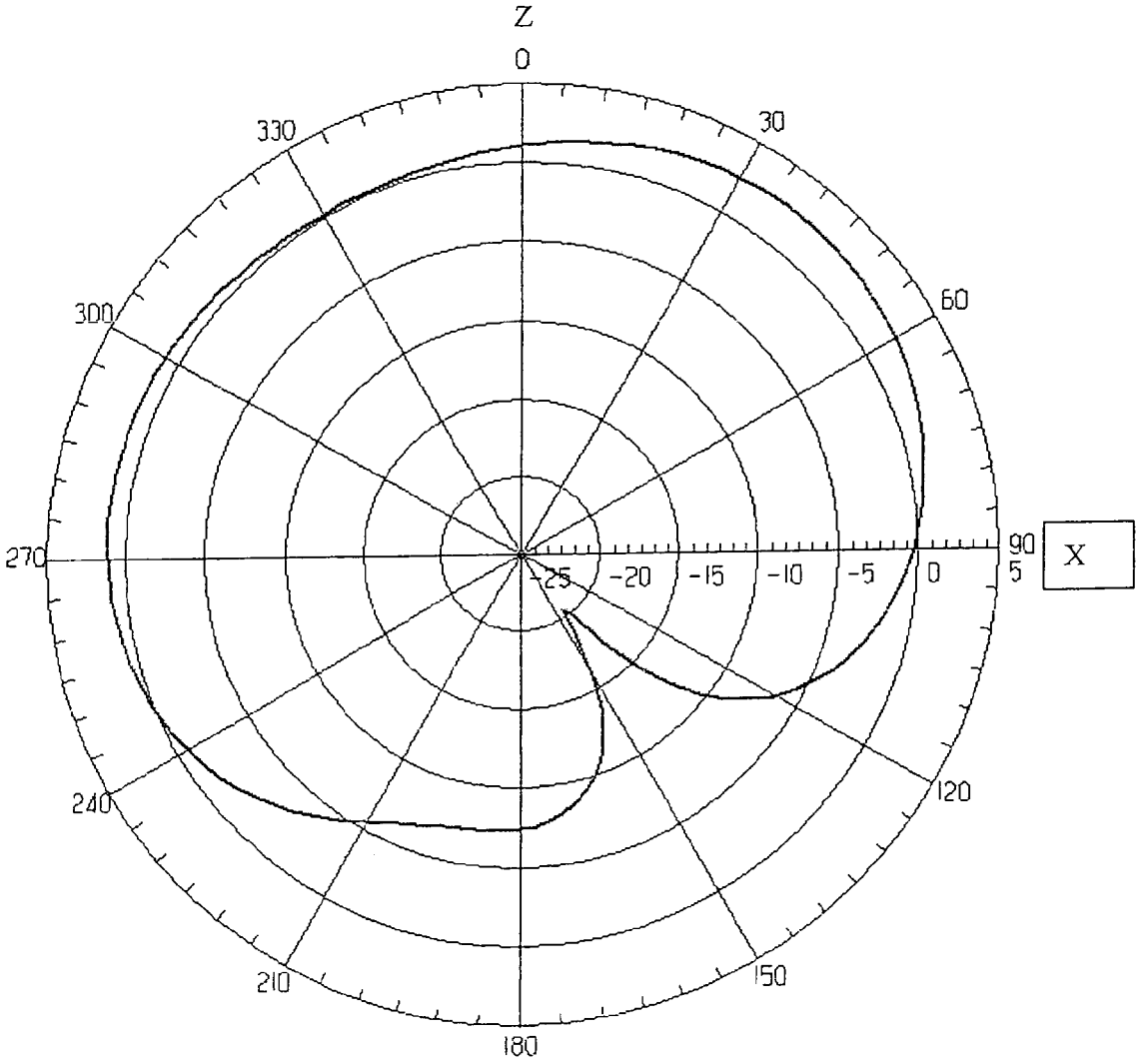
Figure 12:
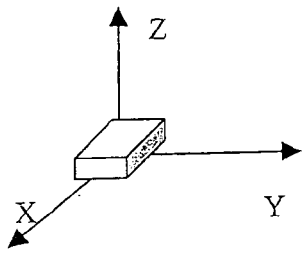
FIG. 12 shows the vertical polarized radiation field of the X-Z plane of the 3D inverted F-antenna according to the present invention, operating at the frequency of 2450 MHz.
Figure 12:
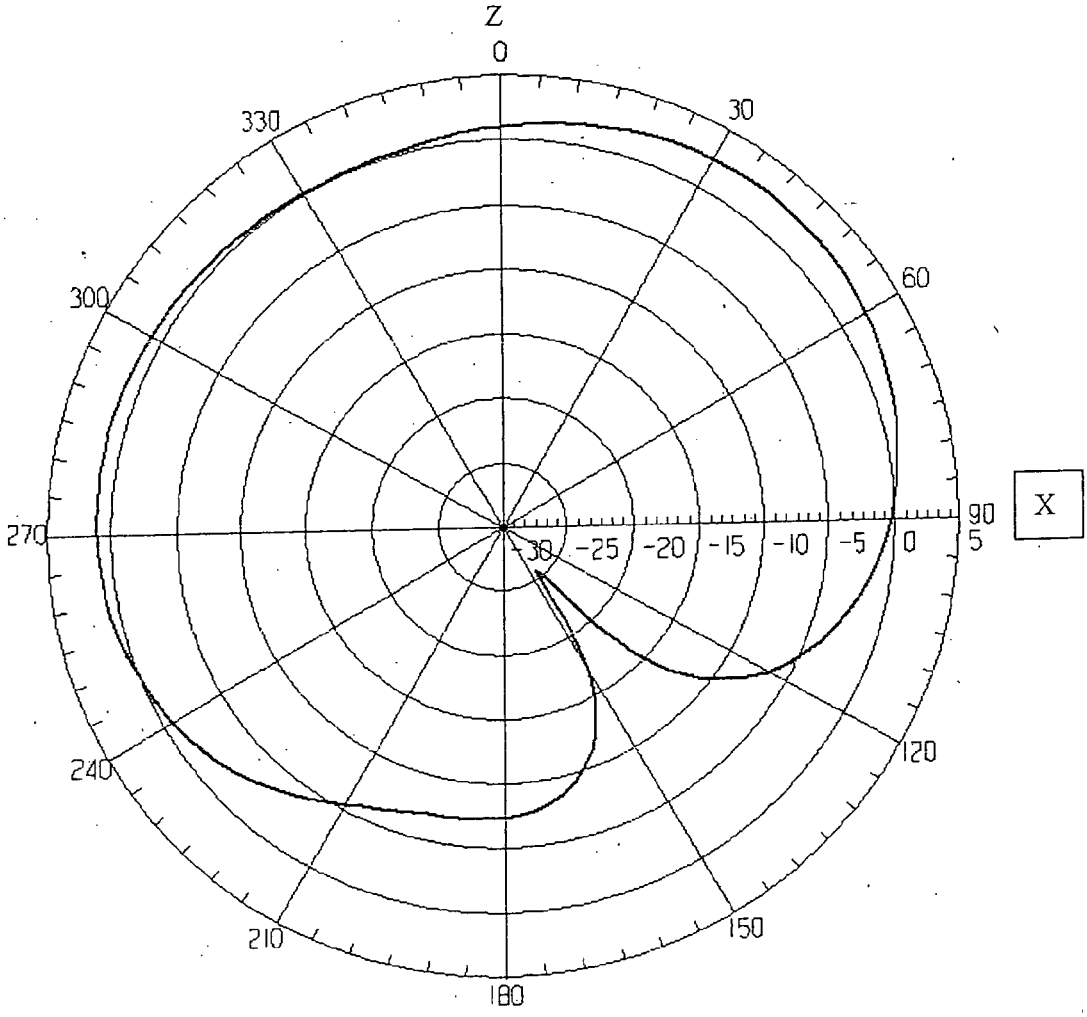
Figure 13:
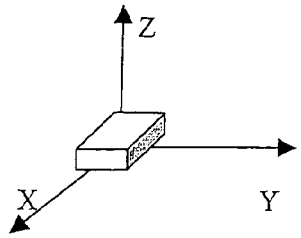
FIG. 13 shows the horizontal polarized radiation field of the X-Z plane of the 3D inverted F-antenna according to the present invention, operating at the frequency of 2450 MHz.
Figure 13:
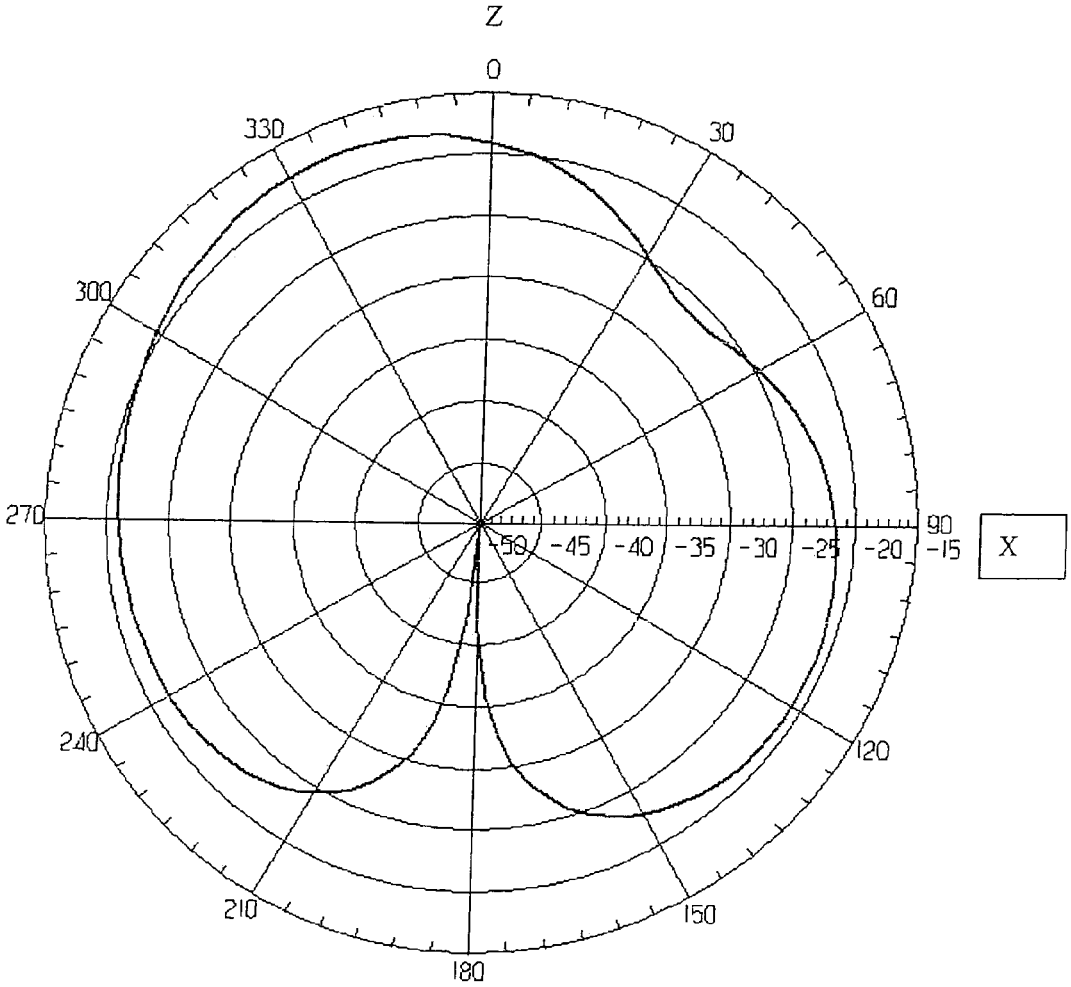
Figure 14:
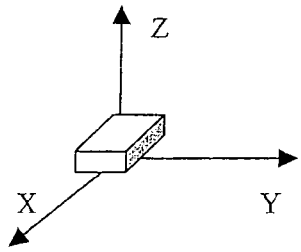
FIG. 14 shows the total radiation field of the Y-Z plane of the 3D inverted F-antenna according to the present invention, operating at the frequency of 2450 MHz.
Figure 14:
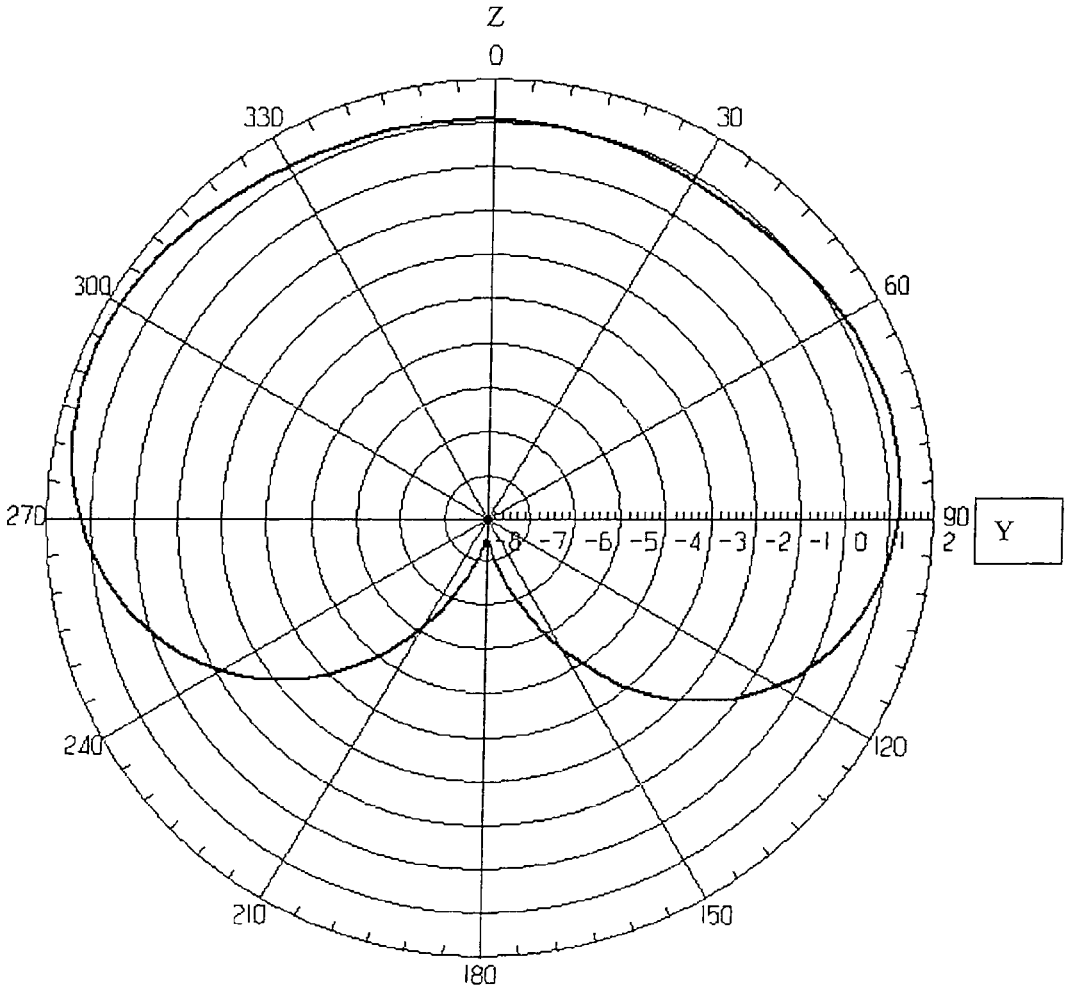
Figure 15:
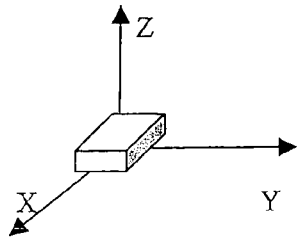
FIG. 15 shows the vertical polarized radiation field of the Y-Z plane of the 3D inverted F-antenna according to the present invention, operating at the frequency of 2450 MHz.
Figure 15:
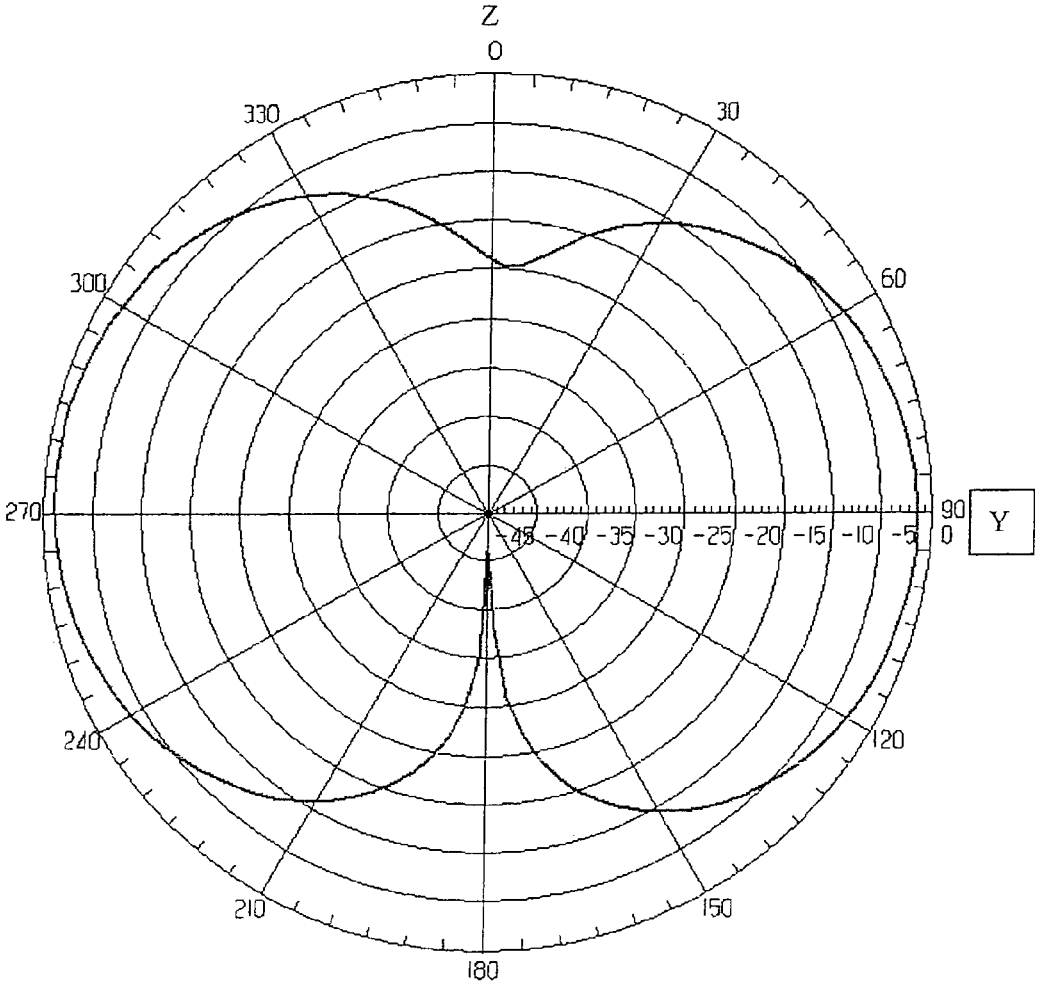
Figure 16:
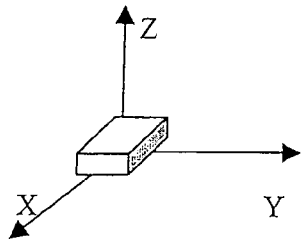
FIG. 16 shows the horizontal polarized radiation field of the Y-Z plane of the 3D inverted F-antenna according to the present invention, operating at the frequency of 2450 MHz.
Figure 16:
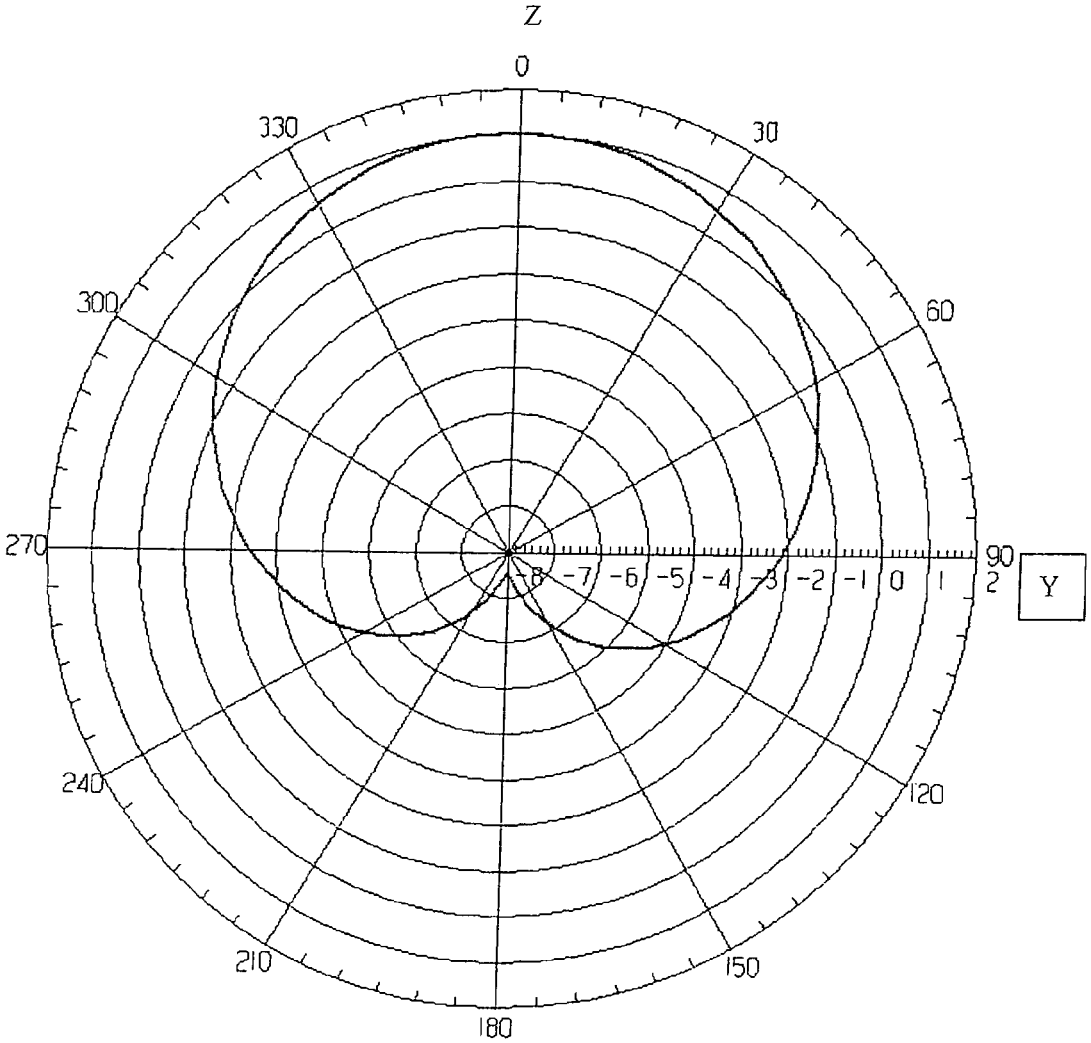

FIG. 6 shows the return loss of the 3D inverted F-antenna according to the present invention. Typically, the Industry standard of the return loss is −10.2 dB. As shown in FIG. 6, when the antenna works between 2400~2500 MHz, the return loss is lower than −10.2 dB. Additionally, when it works in 2450 MHz, the lowest return loss is −7.35 dB. Thus, the impedance match is perfect. FIG. 7 shows the Smith Chart.

When the TEM wire with 50 ohms sends signals to the 3D inverted F-antenna via the feed point 37, the relative electromagnetic radiation field is shown as FIG. 8 to FIG. 16. The total radiation field, the vertical polarized radiation field, and the horizontal polarized radiation field of the X-Y plane are shown as FIG. 8 to FIG. 10 respectively when the 3D inverted F-antenna works in 2450 MHz. Similarly, the total radiation field, the vertical polarized radiation field, and the horizontal polarized radiation field of the X-Z plane are shown as FIG. 11 to FIG. 13 respectively when the 3D inverted F-antenna works in 2450 MHz. And the total radiation field, the vertical polarized radiation field, and the horizontal polarized radiation field of the Y-Z plane are shown as FIG. 14 to FIG. 16 respectively when the 3D inverted F-antenna works in 2450 MHz. As the above figures show, when the 3D inverted F-antenna works in 2450 MHz in X-Y plane, the electromagnetic radiation field is circle and omni-directional. Therefore, the 3D inverted F-antenna according to the invention can provide an excellent azimuthal angle radiation and can receive the signals. It can also be applied in the Wireless LAN technology.

The present invention provides a 3D inverted F-antenna, which is formed by all-in-one process of pressing form in place of the welding process of the short plate welded to the ground plate and the radiating plate. So the manufacturing steps are simplified, and the cost is decreased than before. Besides, it can work under a wider range of bandwidth than that of the conventional antenna because it resonates in ½ of the predetermined resonance wavelength. Thus, it is helpful to the reflector, the first sidewall, and the second sidewall for receiving the vertical polarized wave and horizontal polarized wave. The effect of radiating and receiving signals are improved thereby. Consequently, the 3D inverted F-antenna and its applications are all valuable to the industry.

The foregoing description of the preferred embodiment of this invention has been presented for purposes of illustration and description. Obvious modifications or variations are possible in light of the above teaching. The embodiment was chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A 3D inverted F-antenna, comprising:

a ground plate with a reflector, a first sidewall, and a second sidewall;

a metal sheet having a hole wherein dimensions of said metal sheet and said hole are decided by one over two of a predetermined resonance wavelength;

a short metal sheet connecting said metal sheet and said ground plate;

a media located between said ground plate and said metal sheet for isolating said ground plate and said metal sheet; and a TEM wire located in said ground plate and electrically coupled to said metal sheet for transmitting a signal.

2. The 3D inverted F-antenna according to claim 1, wherein a material of said media is selected from a group consisting of air, styrofoam, and microwave substrate.

3. The 3D inverted F-antenna according to claim 1, wherein said predetermined resonance wavelength is in the ISM (Industry, Science, Medicine) bandwidth.

4. The 3D inverted F-antenna according to claim 1, wherein said first sidewall and said second sidewall are symmetrically located at both side sides of said ground plate.

5. The 3D inverted F-antenna according to claim 1, wherein said ground plate, said metal sheet, said hole, said short metal sheet, said reflector, said first sidewall, and said second sidewall are formed by an all-in-one process.

6. The 3D inverted F-antenna according to claim 1, wherein the space between said metal sheet and said ground plate is higher than a value of 0.03 multiplying the predetermined wavelength.

7. A 3D inverted F-antenna, comprising:

a ground plate with a reflector;

a radiating plate with a hole wherein dimensions of said radiating plate and said hole are decided by one over two of a predetermined resonance wavelength;

a short unit connecting said radiating plate and said ground plate;

a media located between said ground plate and said radiating plate for isolating said ground plate and said radiating plate; and a conductive signal feeding device located in said ground plate and electrically coupled to said radiating plate for transmitting a signal.

8. The 3D inverted F-antenna according to claim 7, wherein said ground plate further comprises a first sidewall and a second sidewall.

9. The 3D inverted F-antenna according to claim 8, wherein said first sidewall and said second sidewall are symmetrically located at both side of the radiating plate.

10. The 3D inverted F-antenna according to claim 9, wherein said ground plate, said radiating plate, said hole, said short unit, said reflector, said first sidewall, and said second sidewall are formed by an all-in-one process.

11. The 3D inverted F-antenna according to claim 7, wherein the a space between said radiating plate and said ground plate is higher than a value of 0.03 multiplying said predetermined wavelength.

* * * * *